US006668401B2

(12) United States Patent
Waters

(10) Patent No.: US 6,668,401 B2
(45) Date of Patent: Dec. 30, 2003

(54) ORIGINAL FOOT FREE PILLOW

(76) Inventor: Oren Waters, 949 Wapello St., Altadena, CA (US) 91001

( * ) Notice: Subject to any disclaimer, the term of this patent is extended or adjusted under 35 U.S.C. 154(b) by 0 days.

(21) Appl. No.: 10/050,397

(22) Filed: Jan. 15, 2002

(65) Prior Publication Data

US 2002/0095729 A1 Jul. 25, 2002

Related U.S. Application Data

(60) Provisional application No. 60/262,979, filed on Jan. 22, 2002.

(51) Int. Cl.[7] ..... A47C 21/02
(52) U.S. Cl. ..... 5/504.1; 5/658
(58) Field of Search ..... 5/504.1, 505.1, 5/506.1, 503.1, 658, 655.9, 953, 648, 651

(56) References Cited

U.S. PATENT DOCUMENTS

| | | | | | |
|---|---|---|---|---|---|
| 1,547,879 | A | * | 7/1925 | Lambert | 5/505.1 X |
| 1,787,832 | A | * | 1/1931 | Mueller | 5/636 |
| 1,972,673 | A | * | 9/1934 | Baird | 5/505.1 X |
| 2,149,140 | A | * | 2/1939 | Gonzalez-Rincones | 5/632 |
| 2,160,443 | A | * | 5/1939 | Schadell | 5/505.1 X |
| 2,646,578 | A | * | 7/1953 | Evans | 5/505.1 X |
| 2,795,802 | A | * | 6/1957 | Myers | 5/632 |
| 3,284,817 | A | * | 11/1966 | Landwirth | 5/647 |
| 3,327,330 | A | * | 6/1967 | McCullough | 5/636 X |
| 3,389,411 | A | * | 6/1968 | Emery | 5/490 |
| 3,555,582 | A | * | 1/1971 | Radford | 5/632 |
| 3,938,205 | A | * | 2/1976 | Spann | 5/632 |
| 4,060,863 | A | * | 12/1977 | Craig | 5/644 |
| 4,173,048 | A | * | 11/1979 | Varaney | 5/632 |
| 4,193,150 | A | * | 3/1980 | Vineberg | 5/655.9 X |
| 4,214,326 | A | * | 7/1980 | Spann | 5/632 |
| 4,233,700 | A | * | 11/1980 | Spann | 5/632 |
| 4,288,879 | A | * | 9/1981 | Pate | 5/631 |
| 4,574,412 | A | * | 3/1986 | Smith | 5/644 X |
| 4,648,142 | A | * | 3/1987 | Bruning | 5/93.1 |
| 4,712,833 | A | * | 12/1987 | Swanson | 5/648 X |
| 4,731,890 | A | * | 3/1988 | Roberts | 5/636 X |
| 4,901,384 | A | * | 2/1990 | Eary | 5/632 |
| 4,980,938 | A | * | 1/1991 | Bivins | 5/648 |
| 5,109,557 | A | * | 5/1992 | Koy et al. | 5/655 |
| 6,052,848 | A | * | 4/2000 | Kelly | 5/632 |
| 6,360,387 | B1 | * | 3/2002 | Everhart | 5/630 |
| 6,502,262 | B1 | * | 1/2003 | Piscopo | 5/655.9 X |
| 2002/0095729 | A1 | * | 7/2002 | Waters | 5/504.1 |

FOREIGN PATENT DOCUMENTS

| | | | | | |
|---|---|---|---|---|---|
| GB | 12180 | A | * | 11/1915 | 5/651 |
| GB | 2116420 | A | * | 9/1983 | 5/651 |

* cited by examiner

*Primary Examiner*—Robert G. Santos
(74) *Attorney, Agent, or Firm*—Clement Cheng

(57) ABSTRACT

A foot free pillow for use on a bed comprising a pillow with a body portion having a wedge shaped cross section, a tapered point formed at the apex of said triangular wedge shaped cross section, said tapered point conforming to the contours of the periphery of a mattress. Also a protrusion can be attached to the body portion at the vertex of the wedge shaped cross section, wherein said protrusion forms a notch allowing said protrusion to be secured against a sheet.

5 Claims, 3 Drawing Sheets

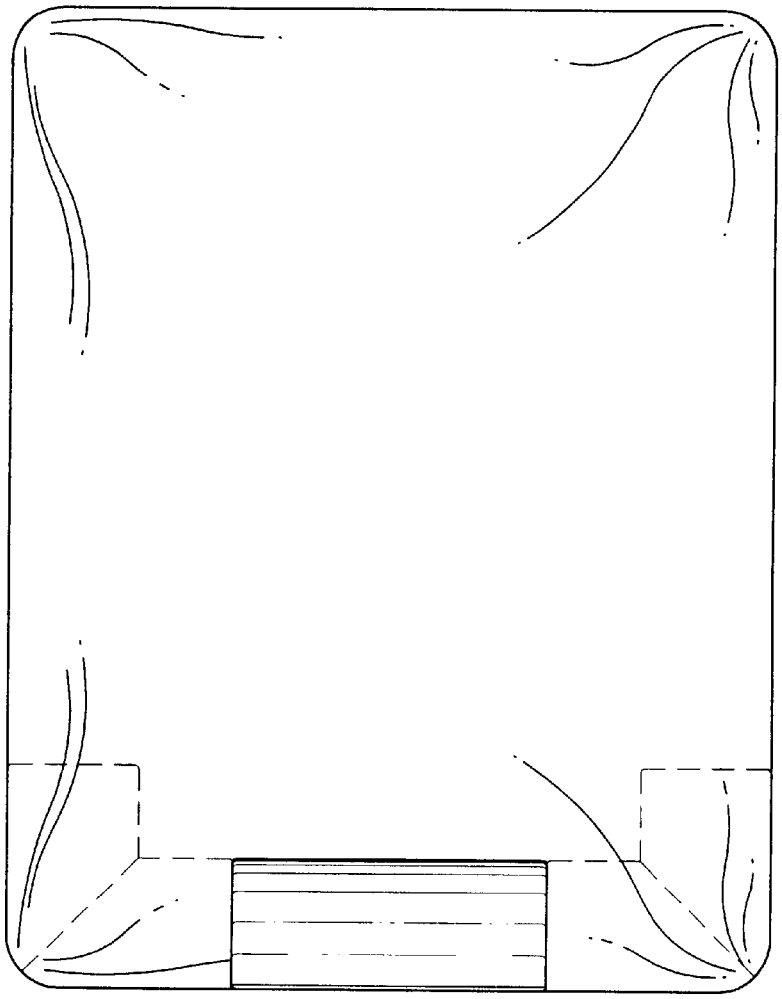
FIG. 3
FIG. 4
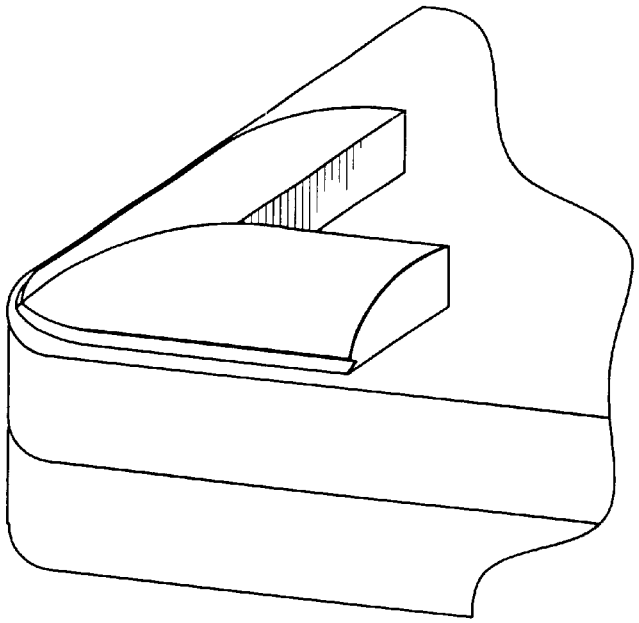

ORIGINAL FOOT FREE PILLOW

This application is the non-provisional filing of the provisional application No. 60/262,979 filed Jan. 22, 2002. The provisional application (by the same inventor) is hereby incorporated by reference and made a portion of this specification. A copy of the originally filed Ser. No. 60/262,979 is included for the examiner's reference. The 4 figures are reproduced verbatim.

BACKGROUND

Most beds are used with bed sheets. People who have slept in a hotel or motel bed know by experience that the sheets can be tucked in very tightly. Tightly fitting sheets may give people a sense of order. Unfortunately, tight sheets are uncomfortable for one's feet and toes. A person sleeping in a bed with tight bed sheets has a hard time turning over and moving due to the constriction around the feet. Where is the freedom for one's feet?

OBJECT OF THE INVENTION

The Original Foot Free Pillow will bring freedom to the foot by raising and retaining bed sheets above fitted sheets to form space for a user's feet.

BRIEF DESCRIPTION OF THE DRAWINGS

FIG. 3 is a top view diagram of the pillow wedge in use.

FIG. 4 is a view of a corner, 'L' shaped pillow.

DESCRIPTION

A bed is commonly made with a fitted sheet around a top mattress. A bed sheet is then placed on top of the fitted sheet and mattress. A comforter is then placed on top of the bed sheet. The comforter and bed sheet are tucked underneath the top mattress. Usually, a bottom mattress supports the top mattress.

Figure 2:
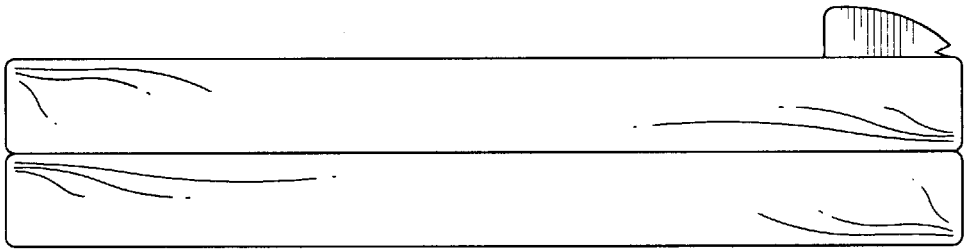
FIG. 2 is a side view diagram of the pillow wedge in use.
Figure 5:
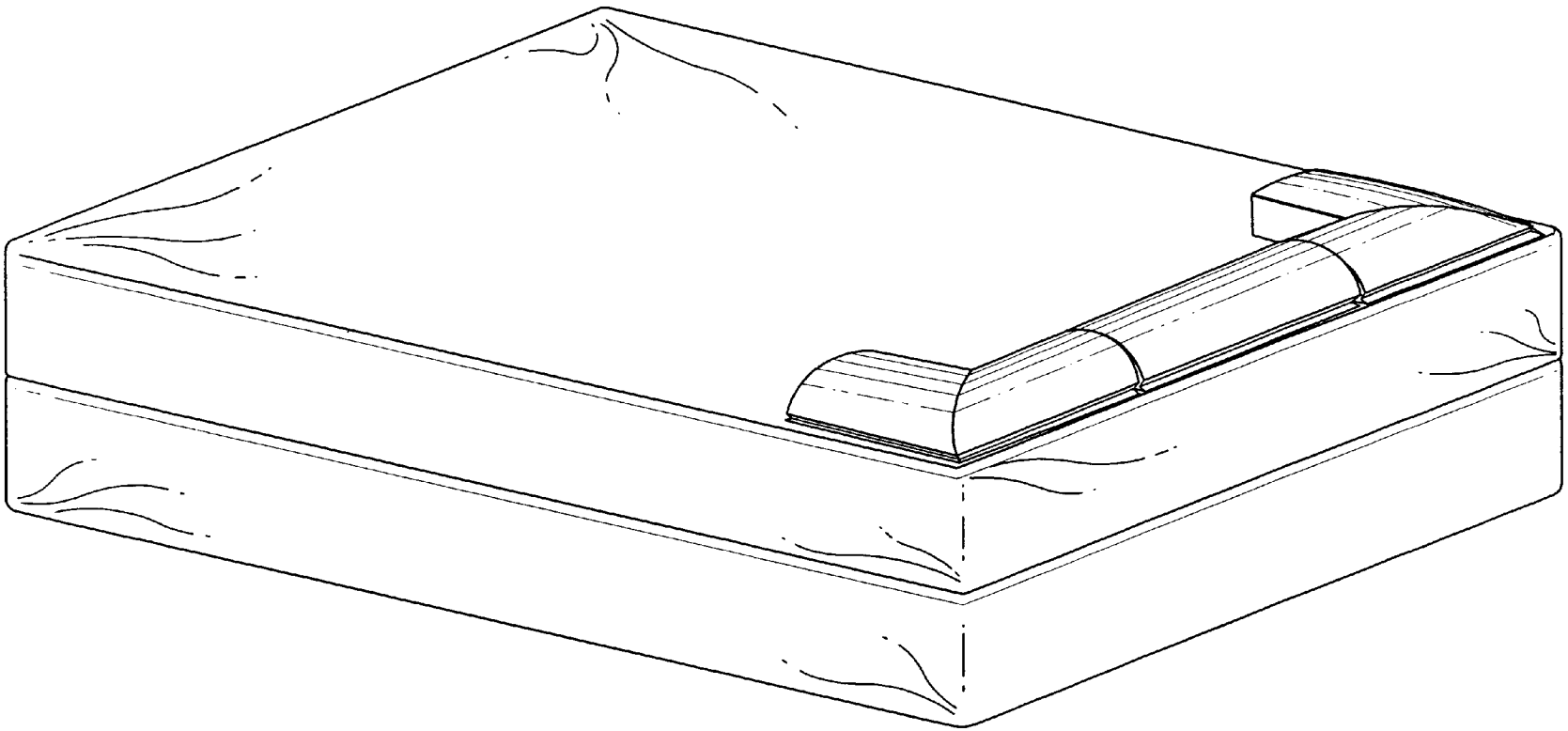
FIG. 5 is a view of a lower half, 'U' shaped pillow.

When the comforter and bed sheet are tucked underneath the top mattress, the bed sheet may be tight and constrict the feet. To alleviate discomfort and constriction around the feet, a foot free pillow can be inserted between the bed sheet and the fitted sheet. The pillow is placed as shown in FIGS. 2 and 3. When making the bed, the pillow can be placed at the interface between the bed sheet and the mattress. The pillow can also be placed between the fitted sheet and the mattress. The pillow can also be a triangular corner piece as shown in FIG. 4. The corner piece would lift the corners of the bed sheet where the bed sheets are the tightest.

The foot free pillow is positioned at the foot of the bed on the mattress. It fits between the sheets and mattress. The foot free pillow allows space between bed sheets while maintaining warmth in the area of the feet. The pillow can be encased in a cover. The cover would preferably be a material comforting to the touch. Flannel and velvet are preferred cover materials because they are comfortable to the touch and also adhere to fabrics well.

The pillow wedge shaped and need only be a few feet in length. A wedge shaped cross section here means a triangular shape. The dictionary definition of wedge is '1. a piece of hard material with two principal faces meeting in a sharply acute angle, for raising, holding, or splitting objects by applying a pounding or driving force, as from a hammer.'

Figure 1:
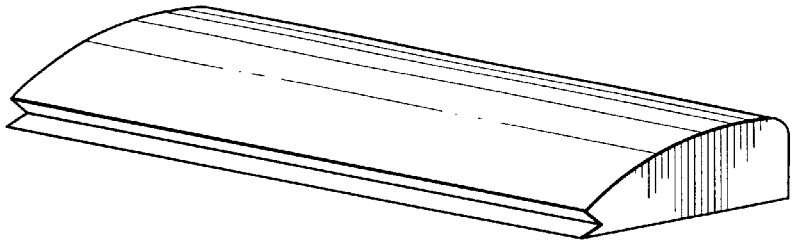
FIG. 1 is a side view of a wedge shaped main body.

The cross section of the pillow is preferably constant. The tapered point of the wedge is positioned at the edge of the bed where the fitted sheet and the bed sheet meet. The tapered point optionally includes a protrusion forming a notch as shown in FIG. 1. The notch allows the protrusion to bend over the edge of the mattress. The bend in the protrusion provides greater holding stability for the pillow should a user kick the pillow while asleep. The theory of operation is that the tension between the bed sheet and mattress holds the protrusion in place.

The pillow raises the bed sheet and comforter several inches higher forming an air gap near a user's feet. Preferably, the user does not rest his feet on the pillow or against the pillow, but rather near the pillow. The air gap provides the user's feet with latitude while allowing the bed sheets to remain tight. The pillow thus enlarges the usable area of the bed by creating latitude in the most needed places.

The pillow can be implemented in a variety of sizes to fit the size of the user and the bed. For example a small size that is only 12" long may be good for twin sized beds while a 48" length would be more suitable for a queen sized bed.

The pillow can also include pockets sewn into the fabric. These pockets can contain herbal scented pouches for aromatherapy. Alternatively, the herbal fragrant pouches may be placed inside a cavity in the foam of the pillow, where the porous pillow allows gradual release of a fresh smell.

The best mode of the invention is to form the pillow of firm foam rather than using cotton or cloth or feather filers. The firm foam retains shape better, which allows proper retention of the wedge in bed sheets. The tapered point can conform to the contours of the periphery of a mattress. Thus, from the drawings, although most beds have straight edges of their periphery, a corner piece can also be made so that the foam retains sheets around the corner of a bed. A corner piece is an L shaped pillow that has an L shaped body and an L shaped tapered point. See FIG. 4. In general, the body runs parallel to the tapered point and the notch, if any. A U shaped pillow is also possible and can be used to surround the lower half of a person's bed.

The pillow can also be outfitted with a vibration mechanism as seen in many other pillow designs. This vibration if tuned in amplitude does not shake loose the pillow, but still offers a soothing touch for tired feet.

What is claimed is:

1. A foot free pillow on a bed mattress comprising:

a. a bed mattress, b. a firm foam body portion having a wedge shaped cross section capable of lifting and retaining bed sheets to provide a space between said bed sheets and said bed mattress for the comfort of a user's feet, c. a cloth cover for the foam body portion, and d. a protrusion attached to the body portion at the vertex of the wedge shaped cross section, wherein said protrusion is to be secured between bed sheets, e. wherein the foot free pillow can be attached to the bed mattress, wherein the pillow is formed with a U shaped body portion and U shaped tapered point where the U shape follows the bottom half periphery of a bed profile, said U shaped body portion parallel to said U shpaed tapered point.

2. A foot free pillow comprising:

a pillow with a firm foam body portion having a wedge shaped cross section, said body portion shaped to lift and retain bed sheets to provide a space for the comfort of a user's feet, a tapered point formed at the apex of said wedge shaped cross section, said tapered point conforming to the contours of the periphery of a mattress, wherein the pillow is formed with a U shaped body portion and tapered point where the U shape follows the bottom periphery of a bed profile.

3. A method of securing bed sheets to form a comfortable space for a user's feet, comprising the steps of:

forming a pillow with a body portion having a wedge shaped cross section tapering at a tapered point, selecting said pillow having a tapered point that follows the periphery of a bed, inserting said tapered point of the pillow at the edge of the bed above a fitted sheet and below the bed sheet, said tapered point assisting in the retaining of the pillow, forming the pillow in a U shape that follows the bottom periphery of a bed profile.

4. A foot free pillow and bed mattress device comprising:

a. a bed mattress, b. a foot free pillow comprising a firm foam body portion having a wedge shaped cross section for lifting and retaining bed sheets to provide a space for the comfort of a user's feet, and a cloth cover for the foam body portion, wherein the foot free pillow attaches to the top of said bed mattress, c. a protrusion at the vertex of the wedge shaped cross section, wherein said protrusion secures between bed sheets, wherein the pillow is formed with a U shaped body portion and U shaped tapered point where the U shape follows the bottom periphery of said bed mattress.

5. A method of securing bed sheets to form a comfortable space for a user's feet, comprising the steps of:

a. forming pillows with a body portion having a wedge shaped cross section tapering at a tapered point, wherein said body portion is formed in a U shape that follows the bottom periphery of a bed profile, b. selecting at least one of said pillows having a tapered point that follows the periphery of a bed, c. inserting said tapered point of the at least one of said pillows at the edge of the bed above a fitted sheet and below the bed sheet, said tapered point assisting in the retaining of the pillow.

* * * * *